US005643287A

United States Patent [19]

Ahad

[11] Patent Number: 5,643,287

[45] Date of Patent: Jul. 1, 1997

[54] DEPILATORY DEVICE

[75] Inventor: Sam J. Ahad, Newhall, Calif.

[73] Assignee: Capehead Enterprises, Inc., Santa Monica, Calif.

[21] Appl. No.: 647,252

[22] Filed: May 9, 1996

[51] Int. Cl.[6] ..... A61B 17/50

[52] U.S. Cl. ..... 606/133; 606/43

[58] Field of Search ..... 606/133, 131, 606/1, 43

[56] References Cited

U.S. PATENT DOCUMENTS

| | | | |
|---|---|---|---|
| 1,588,387 | 6/1926 | Li et al. | 606/133 |
| 2,480,252 | 8/1949 | Magnus | 606/133 |
| 4,524,772 | 6/1985 | Daar et al. | 606/133 |
| 4,807,624 | 2/1989 | Gross et al. | 606/133 |
| 4,825,867 | 5/1989 | Gross et al. | 606/133 |
| 4,923,460 | 5/1990 | Amit | 606/133 |
| 4,923,463 | 5/1990 | Nussbaum | 606/133 |
| 4,983,175 | 1/1991 | Daar et al. | 606/133 |

FOREIGN PATENT DOCUMENTS

| | | | |
|---|---|---|---|
| 270222 | 6/1988 | European Pat. Off. | 606/133 |

*Primary Examiner*—Sam Rimell
*Assistant Examiner*—Justine R. Yu
*Attorney, Agent, or Firm*—David L. Volk; Brendan B. Dix

[57] ABSTRACT

A motor is disposed within a housing. The motor includes a motor shaft. A spring includes a small diameter end and a large diameter end. The motor shaft is inserted into the small diameter end of the spring such that the spring tightly engages the motor shaft. A hook is positioned on a free end of the spring. A spring wire is connected to the housing. A flexible member engages the spring wire and the hook. The motor is connected to an alternating polarity direct current power source for rotating the motor shaft in alternating directions, thereby coiling the flexible member in alternating directions to trap hair within coils formed by the flexible member, then pull the hair, and then release the hair. The alternating polarity direct current power source is manually switched to turn the motor on and off. The alternating polarity direct current power source includes at least one electronic circuit to convert incoming line voltage alternating current to lower voltage alternating polarity direct current.

5 Claims, 8 Drawing Sheets

DEPILATORY DEVICE

BACKGROUND—FIELD OF INVENTION

This invention relates to instruments, specifically to instruments for the physical removal of hair from the skin.

BACKGROUND—DESCRIPTION OF PRIOR ART

Depilatory devices are known in the prior art. U.S. Pat. No. 4,983,175 to Daar et al discloses an electrically powered depilatory device including a hand held portable housing, a hair engagement and removal assembly including elongate elements in mutually twisted engagement and a motor for driving the elongate elements in motion, whereby hair is engaged between the elongate elements and thus removed. The elongate members are coupled to rollers, the rollers being driven by the motor through a gear arrangement.

U.S. Pat. No. 1,588,387 to Li et al discloses a manually powered device which manipulates mutually twisted flexible elements to engage hair between the flexible elements and thus remove the hair. Although Li et al has the advantage of being less complicated and less expensive to manufacture than Daar et at, it has the disadvantage of requiting manual operation to manipulate the flexible elements.

There is a need for an automatic depilatory device having few moving parts for lower cost and higher reliability.

SUMMARY

The depilatory device of the present invention includes a motor disposed within a housing. The motor includes a motor shaft. A spring includes a small diameter end and a large diameter end. The motor shaft is inserted into the small diameter end of the spring such that the spring tightly engages the motor shaft.

A hook is positioned on a free end of the spring. A spring wire is connected to the housing. A flexible member engages the spring wire and the hook.

The motor is connected to an alternating polarity direct current power source for rotating the motor shaft in alternating directions, thereby coiling the flexible member in alternating directions to trap hair within coils formed by the flexible member, then pull the hair, and then release the hair.

The alternating polarity direct current power source is manually switched to turn the motor on and off, and includes an electronic circuit to convert incoming line voltage alternating current to lower voltage alternating polarity direct current.

Because the depilatory device requires no gears or rollers, it is more reliable and less costly than automatic depilatory devices of the prior art.

DETAILED DESCRIPTION

Figure 1:
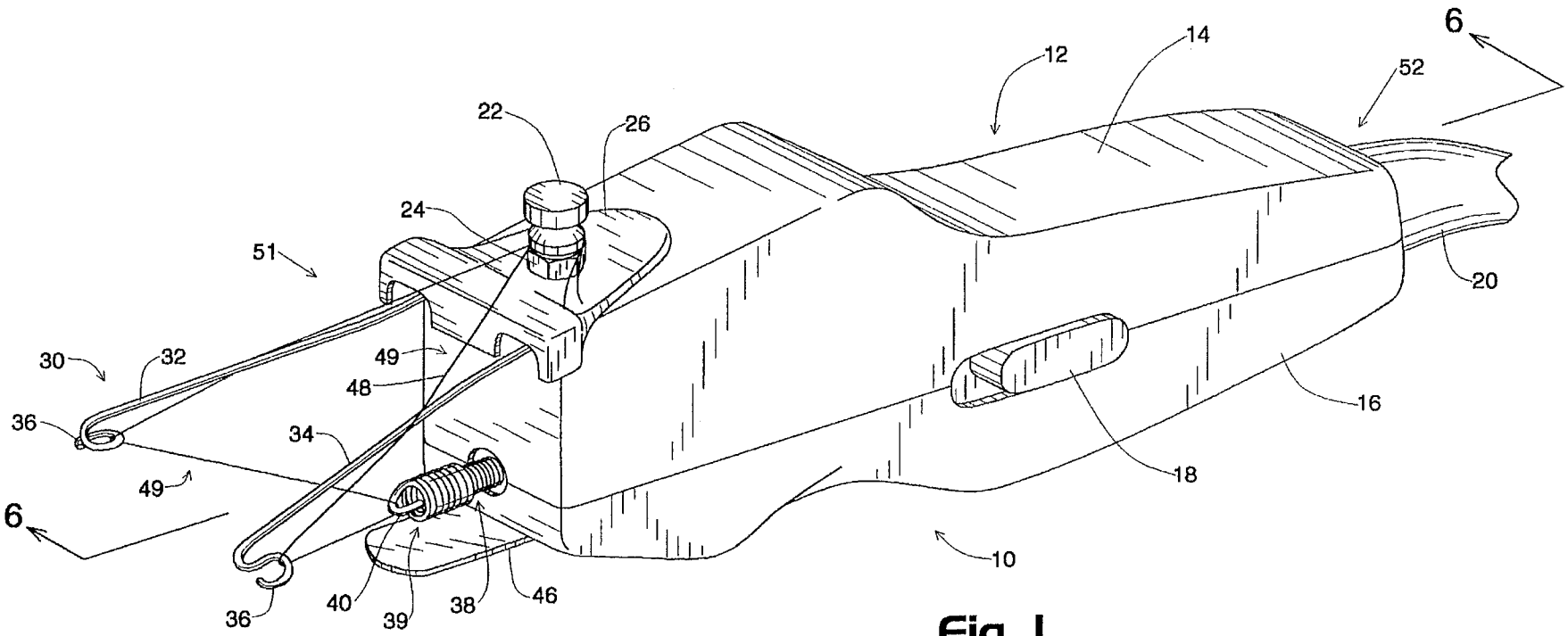
FIG. 1 is a perspective view of the depilatory device.

FIG. 1 is a perspective view of a depilatory device 10. The depilatory device 10 includes a housing 12. The housing 12 includes a top portion 14 and a bottom portion 16. The housing has a front end 51 and a back end 52. A sliding switch 18 is accessible from outside of the housing 12. A power conductor 20 extends outwardly from the back end 52 of the housing 12.

A spring cover 26 is attached to the top portion 14 of the housing 12 near the front end 51 of the housing 12. A spring wire 30 is held in place between the spring cover 26 and the top portion 14 of the housing 12 such that a first arm 32 and a second arm 34 of the spring wire 30 extend outwardly from the housing 12. The end of the first arm 32 and the end of the second arm 34 are each coiled to form a spring eyelet 36.

Figure 2:
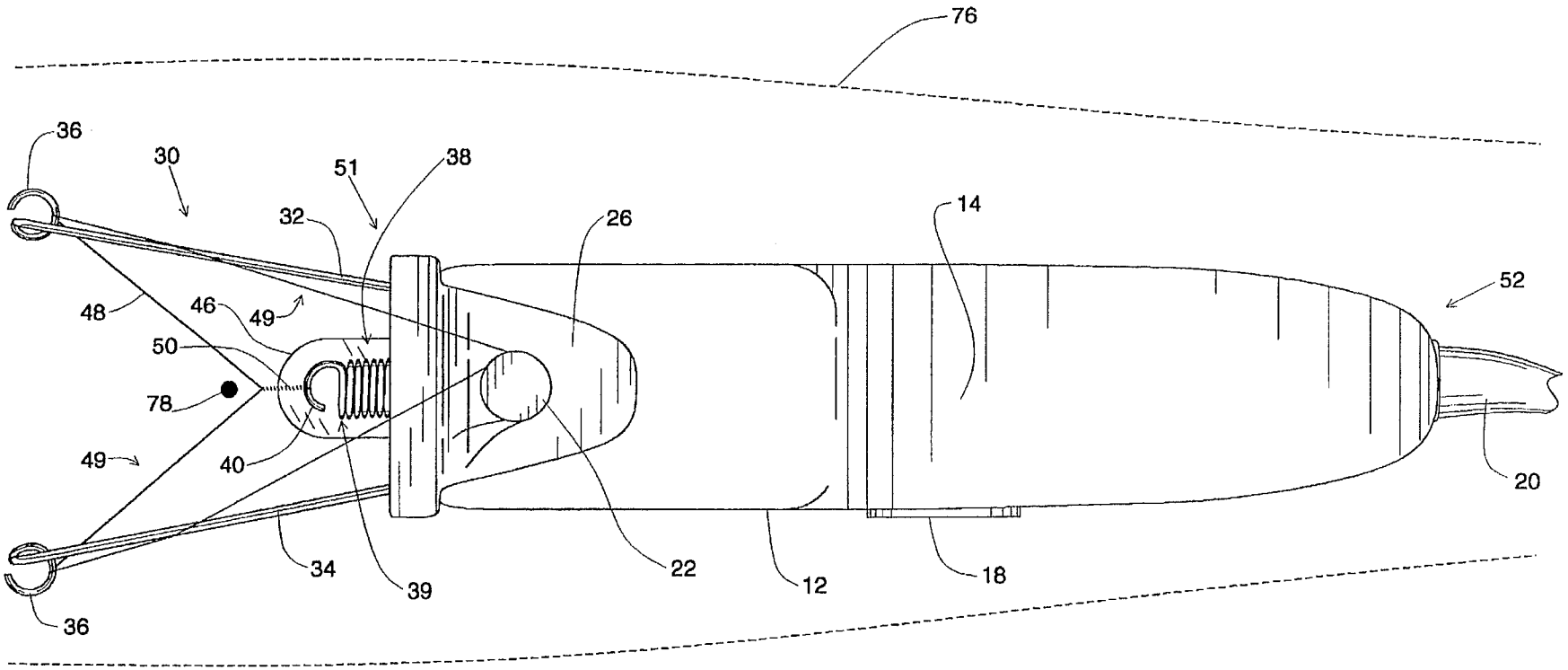
FIG. 2 is a top elevational view of the depilatory device, shown in position to remove a human hair.
Figure 3:
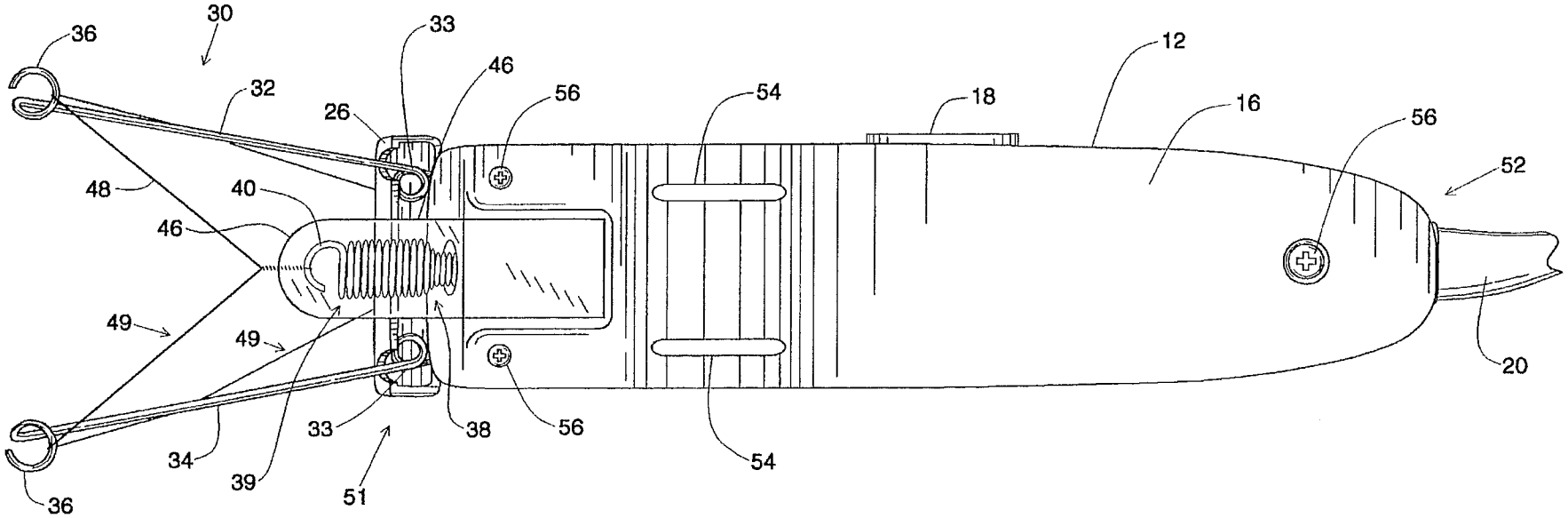
FIG. 3 is a bottom elevational view of the depilatory device.

FIG. 2 is a top elevational view of the depilatory device 10, shown positioned to remove a human hair 78 from a human's skin 76. FIG. 3 is a bottom elevational view of the depilatory device 10. Referring to FIGS. 1, 2 and 3, a spring 38 extends outwardly from the front end 51 of the housing 12. A hook 40 is formed on a free end 39 of the spring 38. A flexible transparent guard 46 is adhesively attached to the bottom portion 16 of the housing 12, and extends beyond the front 51 of the housing 12. The guard 46 is positioned to protect the skin 76 from contact with the spring 38.

Referring to FIG. 1, a flexible member 48 is threaded through the hook 40 such that the flexible member 48 is in contact with the hook 40 substantially at the center of the flexible member 48.

In FIGS. 2 and 3, the spring 38 has been turned along its longitudinal axis, thus turning the hook 40, thereby twisting the flexible member 48 upon itself, creating coils 50.

Referring to FIGS. 1, 2 and 3, the flexible member 48 is further threaded through each of the spring eyelets 36, then threaded around the outside of the first arm 32 and around the outside of the second arm 34.

Figure 4:
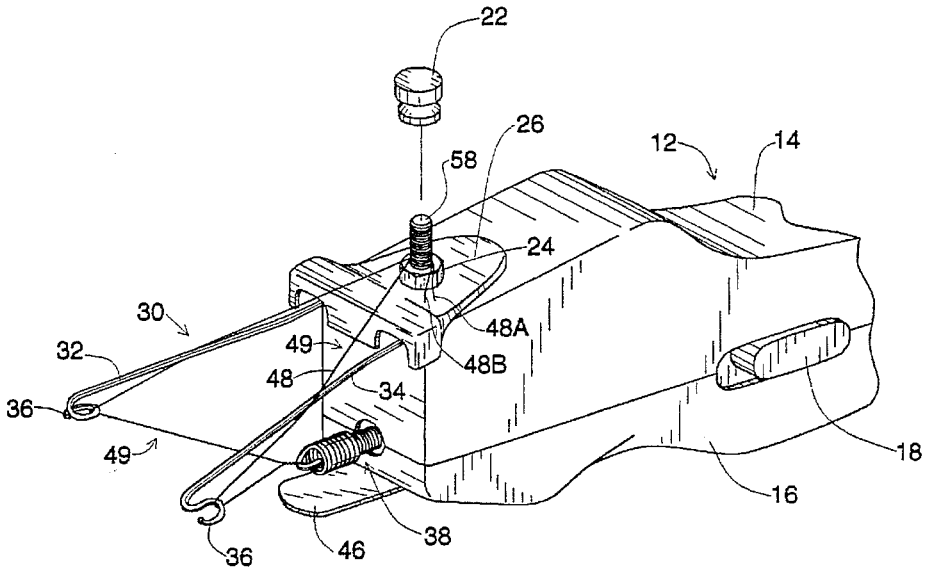
FIG. 4 is a partial perspective view showing the method of attaching the flexible member to the screw.

FIG. 4 is a partial perspective view showing the method of attaching the flexible member 48 to a screw 58. The screw 58 extends upwardly from the spring cover 26. A threaded standoff 24 is threaded onto the screw 58, the standoff 24 thereby holding the spring cover 26 against the top portion 14 of the housing 12. A first end 48A and a second end 48B of the flexible member 48 are wrapped around the screw 58. A knurled nut 22 is threaded over the screw 58 to trap the flexible member 48 between the knurled nut 22 and the standoff 24.

As shown in FIGS. 1 through 4, when the flexible member 48 is properly threaded and attached to the depilatory device 10 as described above, the flexible member 48 forms two substantially v-shaped portions 49, and the flexible member 48 is held in tension by the first arm 32 and the second arm 34 of the spring wire 30.

Figure 5:
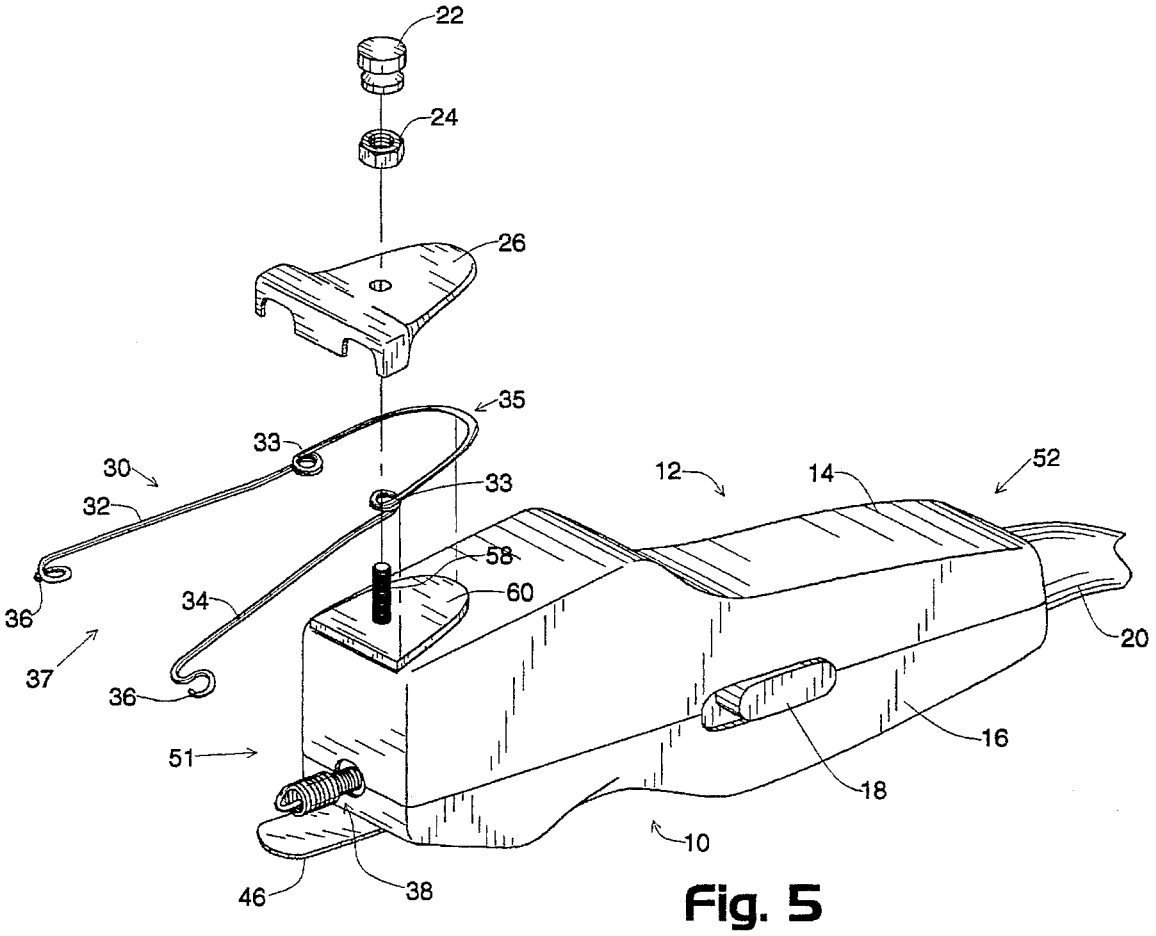
FIG. 5 is a partial perspective view of the depilatory device, including the spring cover and spring wire in exploded view.

FIG. 5 is a partial perspective view of the depilatory device 10, including the spring cover 26 and the spring wire 30 in exploded view. The spring wire 30 is substantially v-shaped. The first arm 32 and the second arm 34 of the spring wire 30 are disposed in a symmetrically diverging relationship to each other. The spring wire 30 has a convergent end 35 and a divergent end 37.

The first arm 32 and the second arm 34 each form a double torsion loop 33 between the convergent end 35 and the divergent end 37. The double torsion loops 33 are arranged to bias the first arm 32 and the second arm 34 apart from each other.

A holding plate 60 is attached to the top portion 14 of the housing 12, near the front end 51 of the housing 12. The holding plate 60 may be attached to the top portion 14 via adhesive or other conventional method, or the holding plate and top portion 14 may be molded as one piece.

Figure 6:
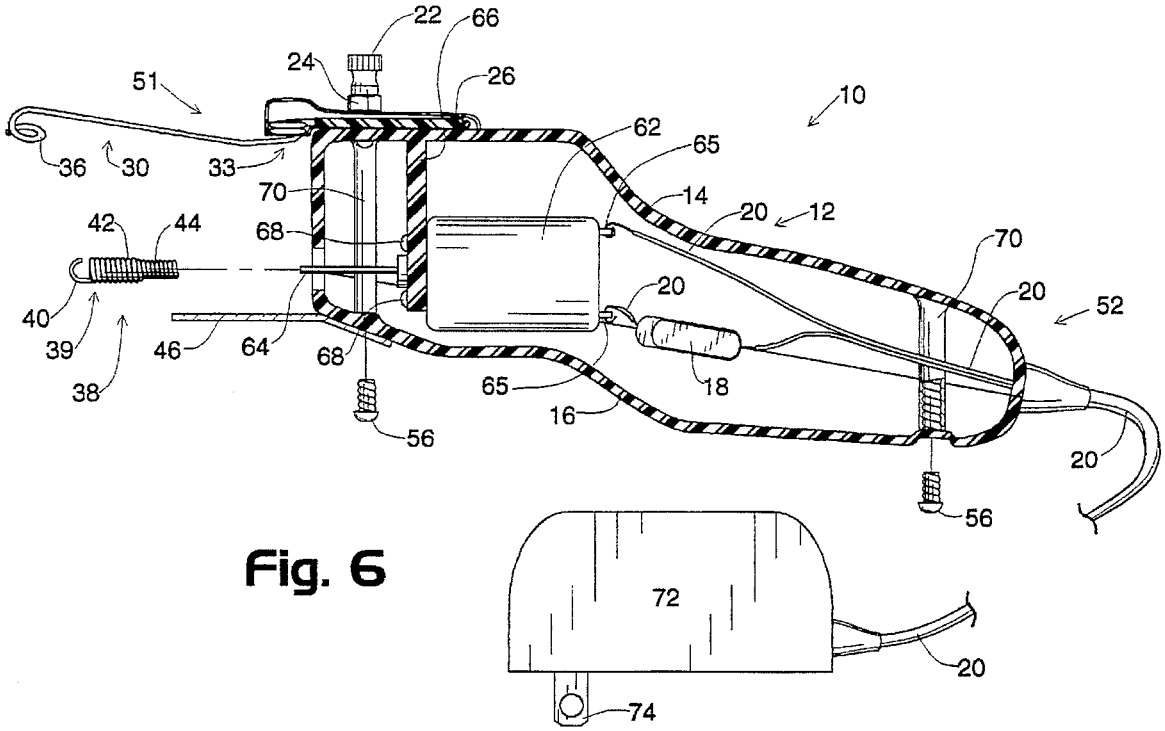
FIG. 6 is a cross-sectional view of the depilatory device, taken along line 6—6 of FIG. 1.

FIG. 6 is a cross-sectional view of the depilatory device 10, taken along line 6—6 of FIG. 1. Referring to FIGS. 5 and 6, the holding plate 60 is configured such that the spring wire 30 fits snugly against and in surrounding relationship to the holding plate 60, such that the holding plate 60 is positioned between the convergent end 35 and the double torsion loops 33. The spring cover 26 fits over the spring wire 30 to hold the spring wire 30 in place. The screw 58 extends upward from the holding plate 60 and through the cover plate 26 when the cover plate 26 is secured to the holding plate 60 by the standoff 24. The cover plate 26 extends beyond the front end 51 of the housing 12 to cover the double torsion loops 33.

Referring to FIG. 6, the top portion 14 and the bottom portion 16 of the housing 12 are connected together via housing screws 56. Internally threaded sleeves 70 are configured and positioned to threadedly engage the housing screws 56. The sleeves 70 may be integrally molded with the top portion 14, or may be connected to the top portion 14 via screws (not shown), adhesive (not shown) or other conventional means.

A motor bracket 66 is attached to the inside of the top portion 14 of the housing 12. The motor bracket 66 may be molded with the top portion 14 as one piece, or the motor bracket 66 may be attached to the top portion 14 by screws (not shown) or other conventional manner. A high-torque direct current motor 62 is attached to the motor bracket 66 via bracket screws 68. The motor 62 includes a motor shaft 64. The motor 62 is positioned within the housing 12 such that the motor shaft 64 extends outward through the from 51 of the housing 12.

A spring 38 includes a large diameter end 42 and a small diameter end 44. The small diameter end 44 is sized to snugly engage the motor shaft 64 when the motor shaft 64 is inserted into the small diameter end 44 of the spring 38. As described above, the spring 38 forms a hook 40 on the free end 39 of the spring 38.

Figure 6A:
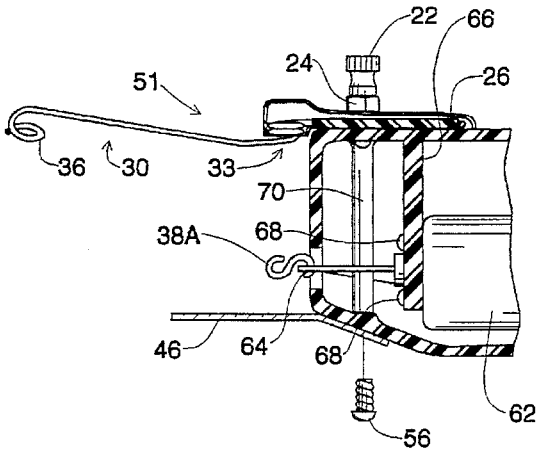
FIG. 6A is a partial cross-sectional view similar to FIG. 6, except that it shows an alternative to the spring on the motor shaft.

FIG. 6A is a partial cross-section similar to FIG. 6, except that it shows an alternative to the spring 38. The spring 38 is replaced by an s-hook 38A inserted through a hole (not shown) in the motor shaft 64. The free end of the s-hook 38A performs the function of the hook 40 of FIG. 6.

Referring to FIG. 6, the conductor 20 is connected to input terminals 65 of the motor 62. The conductor 20 is coupled to the switch 18 to manually turn the motor 62 on and off. The conductor 20 extends out from back end 52 of the housing 12, the conductor 20 being connected at its extreme end to a circuit housing 72. The circuit housing 72 includes a plug 74 configured to fit into a standard alternating current power outlet (not shown).

Figure 7:
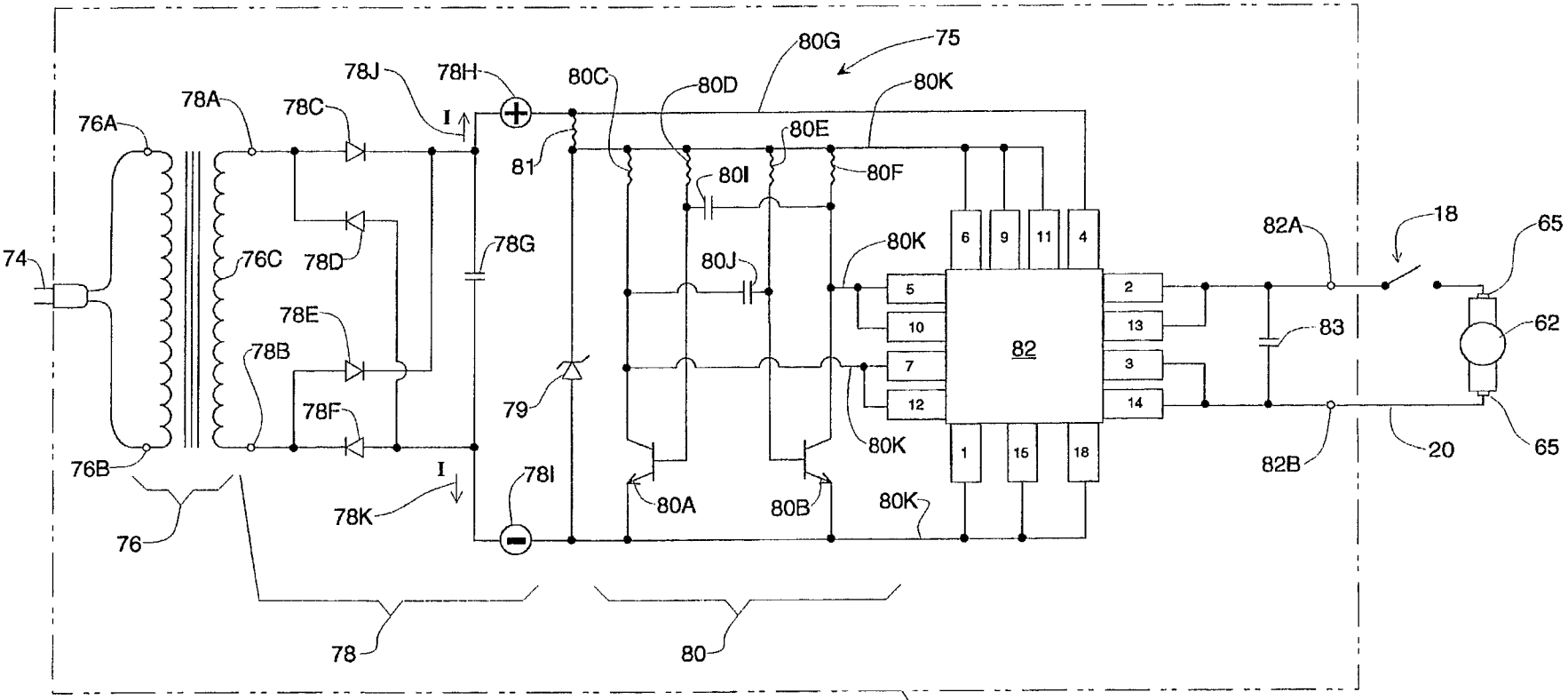
FIG. 7 is a schematic of the electronic circuit which converts line voltage alternating current to alternating polarity direct current.

FIG. 7 is a schematic of an electronic circuit 75 contained within the circuit housing 72. The electronic circuit 75 may take the form of a printed circuit board (not shown). The electronic circuit 75 converts line voltage alternating current to lower voltage alternating polarity direct current.

The plug 74 is coupled to the primary input terminals 76A and 76B of a transformer 76. The transformer 76 converts line voltage alternating current to lower voltage alternating current on a secondary winding 76C of the transformer 76.

The secondary winding 76C of the transformer 76 is coupled to the input terminals 78A and 78B of a rectifier bridge circuit 78. The rectifier bridge circuit 78 includes first through fourth rectifiers 78C, 78D, 78E and 78F respectively, configured to convert the incoming alternating current to positive polarity direct current 78J and negative polarity direct current 78K at first output terminal 78H and second output terminal 78I respectively of the rectifier bridge circuit 78.

An electrolytic capacitor 78G is connected across the output terminals 78H and 78I of the rectifier bridge circuit 78. The electrolytic capacitor 78G filters the direct current output 78J and 78K.

The output terminals 78H and 78I of the rectifier bridge circuit 78 are connected to an astable multivibrator circuit 80. The multivibrator circuit 80 includes transistors 80A and 80B, which are used as solid state switching devices. The transistors 80A and 80B are cross-connected with first through fourth resistors 80C, 80D, 80E and 80F and first and second capacitors 80I and 80J to provide alternating voltages between near-zero and near direct current power supply rail voltage.

A zener diode 79 connected in series with a fifth resistor 81 across the output terminals 78H and 78I of the rectifier bridge circuit 78 acts as a voltage regulator to provide approximately 5 volts direct current to the astable multivibrator circuit 80 and to a power amplifier 82.

The output 80K of the multivibrator circuit 80 is connected to the power amplifier 82 to improve the switching characteristics of the multivibrator circuit 80 and to provide more drive power to the motor 62. The power amplifier 82 shown is a Texas Instruments™ TI Full H Driver™. Alternatively, another suitable integrated or non-integrated circuit may be used.

The output terminals of the power amplifier 82 are connected to the circuit board output terminals 82A and 82B. The circuit board output terminals 82A and 82B are connected to the conductor 20. The conductor 20 includes the switch 18. The conductor 20 is connected to the input terminals 65 of the motor 62.

A third capacitor 83 is connected across the circuit board output terminals 82A and 82B to filter the voltage across the motor 62.

Figure 8:
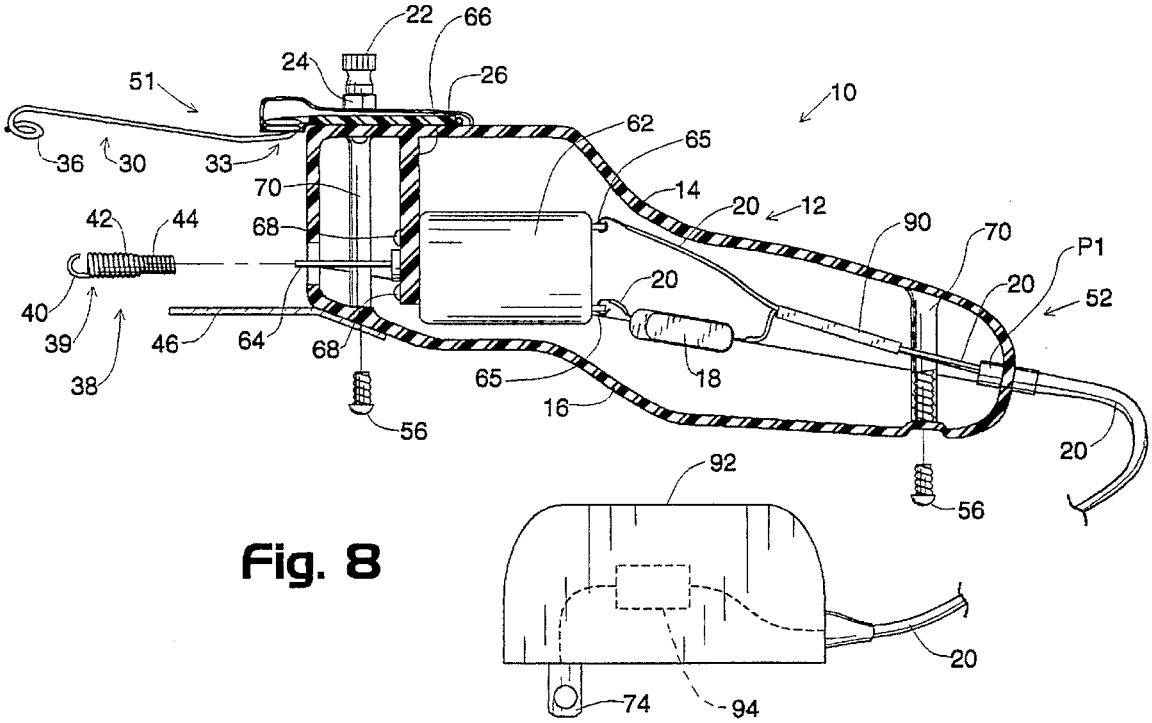
FIG. 8 is a cross-sectional view of the depilatory device, taken along the same line as FIG. 6, showing an alternative embodiment of the depilatory device.

FIG. 8 is a cross-section (taken along the same line as FIG. 6) of an alternative embodiment of the depilatory device 10. In this embodiment, a printed circuit board 90 which accepts direct current single polarity input and provides direct current alternating polarity output is contained within the housing 12. The conductor 20 on the input side of the circuit board carries single polarity direct current, whereas the conductor 20 on the output side of the circuit board carries alternating polarity direct current. The circuit housing 72 of the first embodiment, at the extreme end of the conductor 20 is replaced with a circuit housing 92. The circuit housing 92 contains a circuit 94 which converts the incoming line voltage alternating current to lower voltage direct current. The circuit includes a step-down transformer (not shown) and a rectifier circuit (not shown). The required electronic circuitry to convert alternating current to direct current is well known in the prior art.

Alternatively, the circuit board 90 can receive its input from a source of direct current power such as a battery or battery pack.

Figure 9:
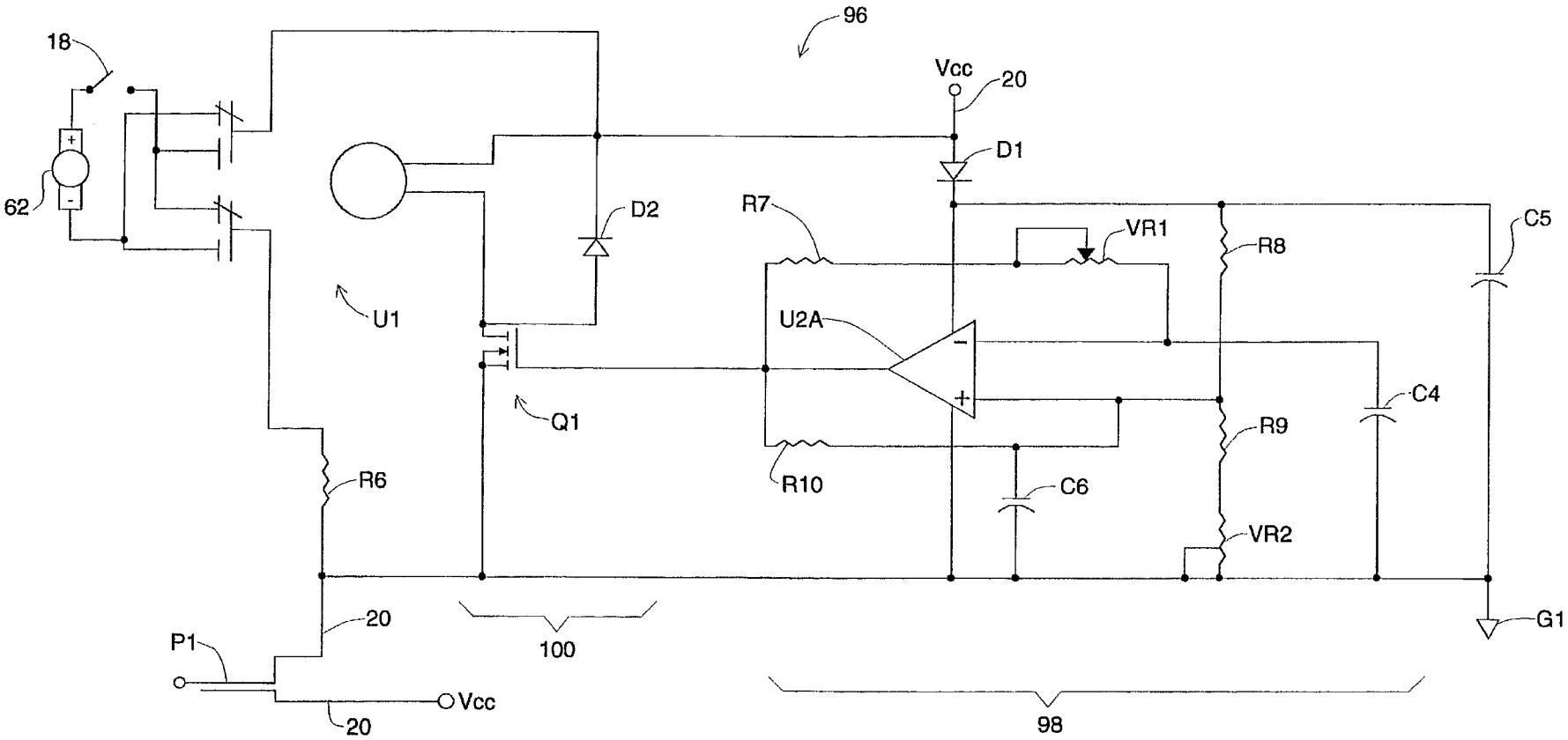
FIG. 9 is a diagram including the circuit contained on the printed circuit board of the alternative embodiment.

FIG. 9 is a diagram including the circuit 96 contained on the printed circuit board 90. The circuit 96 comprises an astable multivibrator circuit 98, an amplifier circuit 100 which comprises a power amplifier Q1, and a double-pole double-throw relay U1 to provide an alternating directional motion to the motor 62. The multivibrator circuit 98 comprises an operational amplifier U2A, seventh through tenth resistors R7, R8, R9 and R10, first and second variable resistors VR1 and VR2, fourth capacitor C4 and sixth capacitor C6.

In this particular realization of the multivibrator circuit 98, the following resistor and capacitor ratings have been found to be adequate, although other ranges are possible. The scope of the invention should not be limited to components with the ranges shown.

Seventh resistor R7: 70k–90k ohms
Eighth resistor R8: 70k–130k ohms.
Ninth resistor R9: 1k–100k ohms.
Tenth resistor R10: 70k—130k ohms.
First variable resistor VR1: 20k—30k ohms.
Second variable resistor VR2: 20k—30k ohms.
Fourth capacitor C4: 0.5–1.5 micro-farads.
Sixth capacitor C6: 0.1–0.3 micro-farads.

Referring to FIGS. 8 and 9, the conductor 20 is separable at a power plug P1.

The following description of operation contains many approximate values which are intended to describe the operation of a particular realization of the multivibrator circuit 98, but are not intended to limit the scope of the invention to any particular values.

Referring to FIG. 9, when power is applied to the circuit 96, the output of the operational amplifier U2A is zero volts. The sixth capacitor C6 begins to charge to less than ½ Vcc through the eighth resistor R8. The resistors R8, R9, R10, and VR2 and the sixth capacitor C6 form a resistor-capacitor time delay circuit, the initial charging time constant of which ranges between approximately 3 milli-seconds (mS) and 3.3 mS. Since the operational amplifier U2A output is zero initially, and since the resistors R7 and VR1 are connected to the operational amplifier U2A output and to the negative input of the operational amplifier U2A, which is connected to the fourth capacitor C4, the voltage on the fourth capacitor C4 is initially zero.

The time constant of the resistor-capacitor circuit connected to the output and the negative input of the operational amplifier U2A ranges between approximately 75 mS and 96 mS, so it is obvious that the voltage on the fourth capacitor C4 initially rises more slowly than the voltage on the sixth capacitor C6. As soon as the voltage on the sixth capacitor C6 exceeds the voltage on the fourth capacitor C4, the output of the operational amplifier U2A rises, changing the characteristics of the resistor-capacitor network comprised of the resistors R8, R9, R10 and VR2 and the sixth capacitor C6 to one which has an additional source of charge through the resistor R10 from the output of the operational amplifier U2A.

Since the output of the operational amplifier U2A will rise to a voltage near Vcc at a rate approximately equal to the ratio of the rates of change of voltage on the fourth capacitor C4 and the sixth capacitor C6, which is approximately 27:1, the voltage developed on the sixth capacitor C6 could only reach a maximum value between approximately 60% and 66% of Vcc, depending on the setting of the second variable resistor VR2, in approximately 5 time constants, or approximately 15 mS.

Meanwhile, the fourth capacitor C4 has been charging at a slower rate through the seventh resistor R7 and the first variable resistor VR1, and will reach a value between approximately 60% and 66% of Vcc in approximately 70 mS to 100 mS, depending upon the settings of the first and the second variable resistors VR1 and VR2, at which time the voltage on the negative input of the operational amplifier U2A will exceed the voltage on the positive input of the operational amplifier U2A, and the output of the operational amplifier U2A will decrease to near zero volts.

At that time, the fourth capacitor C4 and the sixth capacitor C6 begin to discharge through the resistor combinations R7/VR1 and R9/R10/VR2, respectively. While the sixth capacitor C6 will discharge with a time constant of between approximately 3 and 3.3 mS, depending upon the setting of the variable resistor VR2, to a minimum value of between approximately 43% and 49% of Vcc, depending upon the setting of the variable resistor VR2, the fourth capacitor C4 discharges with a time constant of between approximately 75 and 95 mS, depending upon the setting of the first variable resistor VR1.

The voltage on the fourth capacitor C4 reaches a value of approximately 49% of Vcc in approximately 53 mS when the first variable resistor VR1 is set to zero, it reaches a value of approximately 49% of Vcc in approximately 68 mS when the first variable resistor VR1 is set to approximately 20k ohms, it reaches a value of approximately 43% of Vcc in approximately 63 mS when the first variable resistor VR1 is set to zero, and it reaches a value of approximately 43% in approximately 80 mS when the first variable resistor VR1 is set to approximately 20K ohms. When the voltage on the fourth capacitor C4 is less than the minimum voltage on the sixth capacitor C6, the voltage on the positive input of the operational amplifier U2A exceeds the voltage on the negative input of the operational amplifier U2A, and the charging process begins again.

It is obvious, with the adjustability of the charging and discharging circuits of the astable multivibrator circuit 98, that the frequency and the duty cycle, or rectangular wave symmetry, may be altered. If a square wave oscillation is desired, it can be obtained by alternately adjusting the frequency control through the first variable resistor VR1, and the symmetry control through the second variable resistor VR2, such that the period of the full wave is between approximately 140 mS and 160 mS in duration.

The first diode D1 is used as a blocking diode as well as to reduce the supply voltage, Vcc to the operational amplifier U2A. The second diode D2 is used as a commutating diode to clamp the voltage transients at the output of the power amplifier Q1 to the power supply.

The power amplifier Q1 is used to amplify the power to drive the relay coil, U1, from the output of the operational amplifier U2A, when the output voltage of the operational amplifier U2A exceeds the threshold voltage of the gate of the power amplifier Q1, turning on the power amplifier Q1 and causing the contacts of the double-pole double-throw relay U1 to transfer, which, by being cross-connected to the motor 62 causes the motor armature current to reverse, which causes a reversal of the motor armature.

Fifth capacitor C5 is used to filter the supply voltage Vcc.

Because there are also many well known and obvious methods in the prior art for providing alternating polarity direct current, the scope of the present invention should not be limited to any one method.

As an alternative to the above described design which utilizes an alternating polarity direct current, the motor 62 could be powered by single polarity direct current power and the alternating twisting motion of the hook 40 and thus the flexible member 48 could be accomplished by mechanical methods utilizing a gear system (not shown). The scope of the present invention should not be limited to designs which use an alternating polarity direct current.

Operation

Referring to FIG. 2, the depilatory device is held by a human hand (not shown) with the guard 46 resting against the skin 76, and the hair 78 which is to be removed positioned near the juncture of the v-shaped portion 49 and the coils 50. As the hook 40 turns, the number of coils 50 increases toward the hair 78 until the hair 78 becomes trapped within the coils 50. As the coils 50 continue to wind, the hair 78 winds around the axis of the coils 50, the hair 78 eventually being pulled from the skin 76 by this action. As the hook 40 twists in the alternate direction, the flexible member 49 is untwisted, and the removed hair 78 is released.

Thus the depilatory device of the present invention neatly and completely removes unwanted hair, and is lower in cost and more reliable than automatic depilatory devices of the prior art.

While the above description contains many specifics, these should not be construed as limitations on the scope of the invention, but rather as an exemplification of one preferred embodiment thereof. Many variations are possible.

Accordingly, the scope of the invention should be determined not by the embodiment illustrated, but by the appended claims and their legal equivalents.

The invention claimed is:

1. A depilatory device comprising:

a. a spring wire, said spring wire having a first arm and a second arm, said first arm and said second arm disposed in a symmetrically diverging relationship to each other, said first and second arms opposedly biased from each other;

b. said spring wire having a divergent end and a convergent end;

c. a housing having a wire mounting means for mounting said spring wire to said housing, said wire mounting means holding said convergent end of said spring wire against said housing, said first arm and said second arm extending outwardly from said housing;

d. a flexible member;

e. said first arm and said second arm each having a guide means for guidingly engaging said flexible member;

f. a motor disposed within said housing, said motor having a motor shaft, said motor shaft having a free end;

g. an engaging means for engaging said flexible member, said engaging means attached to said free end of said motor shaft;

h. an anchoring means for anchoring said flexible member to said housing, said anchoring means attached to said housing between said first arm and said second arm near said convergent end;

i. said flexible member having a first end and a second end, said flexible member threaded through said engaging means such that said flexible member is in contact with said engaging means substantially at the center of said flexible member, said flexible member further threaded through each of said guide means, said flexible member threaded around the outside of each of said first arm and said second arm, said first and second ends of said flexible member attached to said anchoring means, said flexible member thereby forming two substantially v-shaped portions, said flexible member held in tension by said first and second arms;

j. said motor connected to an alternating polarity direct current power source for rotating said motor shaft in alternating directions, thereby coiling said flexible member in alternating directions.

2. A depilatory device comprising:

a. a spring wire, said spring wire having a first arm and a second arm, said first arm and said second arm disposed in a symmetrically diverging relationship to each other;

b. said spring wire having a divergent end and a convergent end;

c. each of said first and second arms having a double torsion loop between its divergent and convergent ends, said double torsion loops in mirroring relationship to each other, said double torsion loops arranged to bias said first arm and said second arm apart from each other;

d. a housing having a wire mounting means for mounting said spring wire to said housing, said wire mounting means holding said convergent end of said spring wire against said housing, said first arm and said second arm extending outwardly from said housing;

e. said first arm and said second arm each forming a guide means for guidingly engaging a flexible member, said guide means located at said divergent end of said spring wire;

f. a motor disposed within said housing, said motor having a motor shaft, said motor shaft having a free end;

g. an engaging means for engaging said flexible member, said engaging means attached to said free end of said motor shaft;

h. an anchoring means for anchoring said flexible member to said housing, said anchoring means attached to said housing between said first arm and said second arm, between said double torsion loops and said convergent end;

i. said flexible member having a first end and a second end, said flexible member threaded through said engaging means such that said flexible member is in contact with said engaging means substantially at the center of said flexible member, said flexible member further threaded through each of said guide means, said flexible member threaded around the outside of each of said first arm and said second arm, said first and second ends of said flexible member removably attached to said anchoring means, said flexible member thereby forming two substantially v-shaped portions, said flexible member held in tension by said first and second arms;

j. said motor connected to an alternating polarity direct current power source for rotating said motor shaft in alternating directions, thereby coiling said flexible member in alternating directions.

3. The depilatory device of claim 2, wherein said alternating polarity direct current power source is manually switched to selectively turn said motor on and off, and wherein said alternating polarity direct current power source comprises:

a. a plug configured to fit into an alternating current power outlet;

b. said plug coupled to the primary input terminals of a transformer for converting line voltage alternating current to lower voltage alternating current on a secondary winding of said transformer;

c. said secondary winding of said transformer coupled to the input terminals of a rectifier bridge circuit for producing direct current having a positive and a negative polarity at output terminals of said rectifier bridge circuit;

d. said output terminals of said rectifier bridge circuit connected to an astable multivibrator circuit, said multivibrator circuit having a plurality of transistors used as solid state switching devices, said transistors cross-connected with resistor-capacitor combinations so as to provide alternating voltages between near-zero and near direct current power supply rail voltage;

e. the output of said astable multivibrator circuit connected to a power amplifier circuit to improve the switching characteristics of the astable multivibrator circuit and to provide more drive power to said motor;

the output of said power amplifier circuit connected to a conductor, said conductor coupled to the input terminals of said motor.

4. The depilatory device of claim 2, wherein said alternating polarity direct current power source is manually switched to selectively turn said motor on and off, and wherein said alternating polarity direct current power source comprises:

a. a means for providing single polarity direct current power;

b. said means for providing single polarity direct current power coupled to a circuit means for alternating the polarity of the direct current power to drive said motor shaft in alternating directions.

5. The depilatory device of claim 4, wherein said circuit means comprises:

a. a multivibrator circuit and power amplifier circuit in combination to transfer the contacts of a double-pole, double-throw relay at a predetermined rate, thereby reversing the current through said motor.

* * * * *